United States Patent [19]

Goodell

[11] Patent Number: 4,581,872

[45] **Date of Patent: * Apr. 15, 1986**

[54] GUIDE FINGER MOUNTING FOR CASE PACKER ASSEMBLY HEADS

[75] Inventor: Daniel L. Goodell, Tallmadge, Ohio

[73] Assignee: Figgie International Inc., Cleveland, Ohio

[ * ] Notice: The portion of the term of this patent subsequent to Apr. 2, 2002 has been disclaimed.

[21] Appl. No.: 657,835

[22] Filed: Oct. 5, 1984

Related U.S. Application Data

[62] Division of Ser. No. 349,264, Jan. 16, 1982, Pat. No. 4,507,905.

[51] Int. Cl.[4] ..... B65B 39/02; B65B 5/08

[52] U.S. Cl. ..... 53/248; 53/262

[58] Field of Search ..... 53/248, 262, 497, 539, 53/247

[56] References Cited

U.S. PATENT DOCUMENTS

| | | | |
|---|---|---|---|
| 3,271,928 | 9/1966 | Wild | 53/248 |
| 3,908,339 | 9/1975 | Kennedy et al. | 53/248 |
| 3,911,647 | 10/1975 | Hartness et al. | 53/248 |
| 4,033,095 | 7/1977 | Wild | 53/248 |
| 4,075,819 | 2/1978 | Raudat et al. | 53/262 X |
| 4,170,096 | 10/1979 | Wild | 53/248 |
| 4,207,722 | 6/1980 | Raudat | 53/262 X |

*Primary Examiner*—Horace M. Culver

*Attorney, Agent, or Firm*—Oldham, Oldham & Weber, Co.

[57] ABSTRACT

A guide finger mounting apparatus including positioning member having two flat surfaces extending longitudinally of the member, a pair of spring drop finger means one engaging each flat surface on the positioned member and a clip means engaging the fingers and the positioning member to retain the finger means in operative engagement. Complementary interengaging means may be formed on the finger means and the positioning member to aid in preventing relative movement therebetween.

3 Claims, 16 Drawing Figures

GUIDE FINGER MOUNTING FOR CASE PACKER ASSEMBLY HEADS

CROSS-REFERENCE

This is a divisional application of application Ser. No. 349,264 initially filed Jan. 16, 1982 now U.S. Pat No. 4,507,905 issued Apr. 2, 1985.

TECHNICAL FIELD

The present invention relates to article packaging operations and particularly to case packers having assembly heads wherein streams of abutted articles are arranged in case filling patterns and then groups of articles are dropped through the case packer apparatus for deposit into a case, the present invention particularly relating to guide fingers and the mounting means therefore used in these case packer assembly heads.

BACKGROUND ART

Initially, in case packers, there were both transversely and longitudinally extending partition and/or guide plates provided in the case pack assembly head and the spring fingers would be positioned on both of these longitudinally and transversely extending partition plates. However, for guite a few years, nearly all case packer heads have been improved so that many case packer heads in commercial use provide only partition or guide plates extending in one direction of the case packer head. Thus the drop fingers, which must engage the articles being dropped down into a case are so positioned that four fingers can still be provided to engage spaced circumferential areas of the processed articles to engage them for accurate control of the drop of the article to the case.

One prior type of a positioning means for guide or drop fingers in these packing head grids is a structure shown in Bruce Copping, et al, U.S. Pat. No. 3,385,027 while an early type of a finger mounting bracket is shown in U.S. Pat. No. 3,325,967.

Yet a further structure involving "corner mounting" means for guide fingers is the bottle packing grid of U.S. Pat. No. 4,033,095, wherein the individual drop fingers are secured by cap screws and retainer plates or bars to a mounting bracket secured to a guide plate positioned in the bottle packing assembly or grid.

In such prior structures, the drop fingers usually are secured in place by cap screws, rivets, bolts or other means and the repositioning or replacement of the fingers thus requires the worker to have some tools available for finger removal and replacement. Usually the finger replacement or repair is a somewhat time consuming job. Since these drop fingers may break or be damaged when in service, any repositioning or replacement of the guide fingers may necessitate shutting down the apparatus until the guide finger is properly replaced. Thus, it is undesirable to have these guide or drop fingers positioned in the case packing head in such a manner as to require any great amount of time for finger removal and replacement.

DISCLOSURE OF INVENTION

The general object of the present invention is to provide a new and improved guide finger mounting for case packer assembly heads and especially to provide a guide finger mounting wherein the fingers can be replaced without the use of any tools.

Other objects of the invention are to provide a relatively uncomplicated but yet positive means for assembling or mounting guide or drop fingers in the grids of case packer assembly heads and to retain or clamp the fingers in position but yet to permit quick positive release of the guide fingers when desired; and to provide an improved spring drop finger assembly.

Another object of the invention is to facilitate maintenance and to obtain improved efficiency in the use and operation of case packer asssembly heads and similar apparatus utilized in the positioning of articles in cases for shipment or other transport action as desired.

It is yet a further object of the invention to mount a plastic grid finger, or drop finger onto a packing head grid so it can be removed without tools, and which finger is positively positioned so that it is not able to be removed accidentally on impact with packing cases, bottles or other articles.

The present invention particularly relates to the packaging of articles such as soft drinks, beer and other liquid containers but any type of an article can be packaged or processed by the packer apparatus of the invention. The assembly heads provided in the apparatus are adapted to assemble the articles being processed into case filling groups and to drop them down into a case or container for transport or storage, as shown in U.S. Pat. No. 3,052,071.

These and other objects of the invention will become more apparatus as the specification proceeds, are achieved by; a guide finger mounting apparatus for use in case packers or the like, the mounting apparatus comprising; a positioning member having two surfaces extending longitudinally of the member, which surfces are adapted to receive end portions of springs drop thereon; a pair of spring drop finger means, each engaging one of said surfaces of said positioning member; complementary interengaging means formed on said finger means and said positioning member on said surface thereof; and a clip means engaging said finger means and said positioning member to retain said finger means in operative engagement with said positioning member.

Additionally, a guide finger mounting apparatus for case packers having article assembly heads including partition plate means extending the length of one dimension of the assembly head and where means feed streams of abutted articles onto the assembly head in rows between pairs of adjacent partition plate means, the mounting apparatus comprising: a positioning member having two flat outer surfaces extending longitudinally of the member and having a V-shaped in horizontal section; a pair of spring drop finger means such one being positioned on one of said flat surfaces of said positioning member; and a clip means engaging said finger means and said positioning member to retain said finger means in operative position thereon, said finger means such having a portion thereon engaging said positioning member.

BRIEF DESCRIPTION OF DRAWINGS

In the accompanying drawings.

When referring to corresponding numbers shown in the drawings and referred to in the specification, corresponding numerals are used to facilitate comparison therebetween.

BEST MODE FOR CARRYING OUT THE INVENTION

Figure 1:
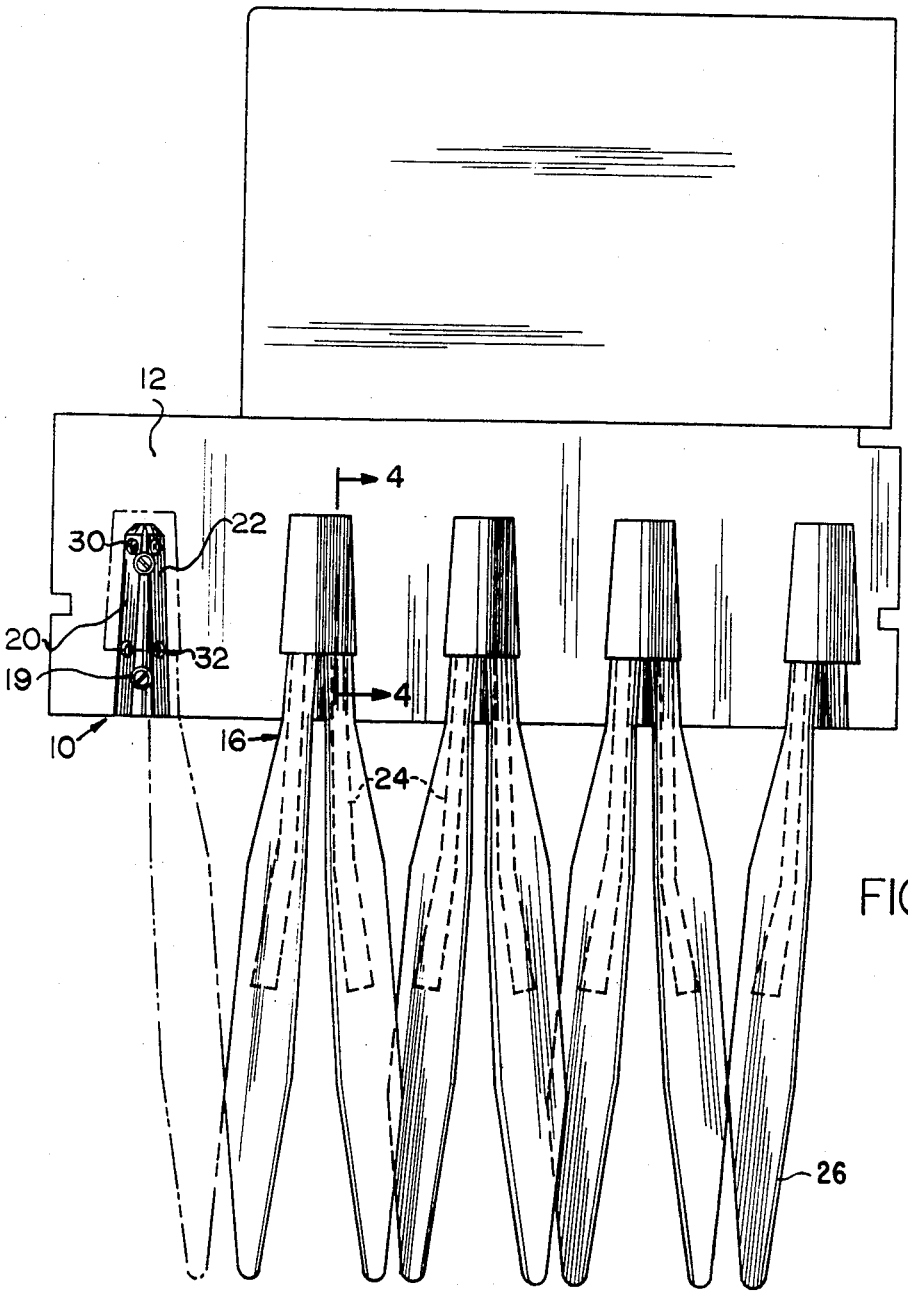
FIG. 1 is a side elevation of a fragment of a case packer grid head and associated means and especially showing the spring drop fingers and positioning means therefore.

A guide finger mounting apparatus embodying the principles of the invention is indicated as a whole by the numeral 10 in FIG. 1 of the drawings. These guide finger mounting members or apparatus are positioned on the sides of guide or partition plates 12 that extend one dimension of the case packer grid head assembly 14 as diagrammatically illustrated in FIG. 2 of the drawings. This grid assembly would be used in apparatus such as shown in U.S. Pat. No. 3,052,071 wherein the streams of abutted articles to be packaged would be fed down between the upper portions of pairs of the partition plates 12 and be received in this grid assembly to be collected into groups of articles for filling a package adapted to receive the articles for transport, storage or other action. The guide finger mounting means of the invention is adapted to position spring finger means 16 to depend from the partition plates and wherein a plurality of the spring finger means 16 are provided in each article receiving area or portion of the grid assembly 14 so that articles to be dropped through the grid assembly will be engaged by the spring finger means at a plurality, usually four, spaced circumferential portions of the article. Hence, the article is accurately guided into proper position in the case used for receiving the articles to be packaged.

Figure 8C:
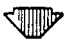
FIGS. 8*a*, 8*b*, 8*c* and 8*d* are front elevation, right side elevation, top plan and bottom plan, respectively, of the spring finger mounting block of FIG. 1.
Figure 8A:
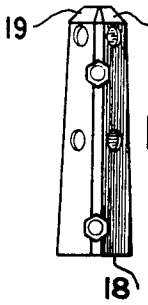
Figure 8B:
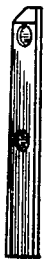
Figure 9A:
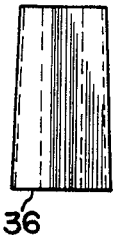
Figure 9B:
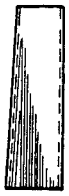

The guide finger mounting apparatus particularly includes positioning members or blocks 18 which blocks or members are elongate and have two outer adjacent or contiguous surfaces 20 and 22, FIG. 8*a*, formed thereon and extending longitudinally thereof. These surfaces 20 and 22 are usually flat and are adapted to receive the end portions of an individual spring finger means on each said surface. The contiguous flat surfaces 20 and 22, in cross-section, form any suitable V-shaped angle. Bottles or articles to be packaged are indicated at B in FIG. 2. The positioning members 18 may be attached to the partition plates by bolts 19.

Figure 3:
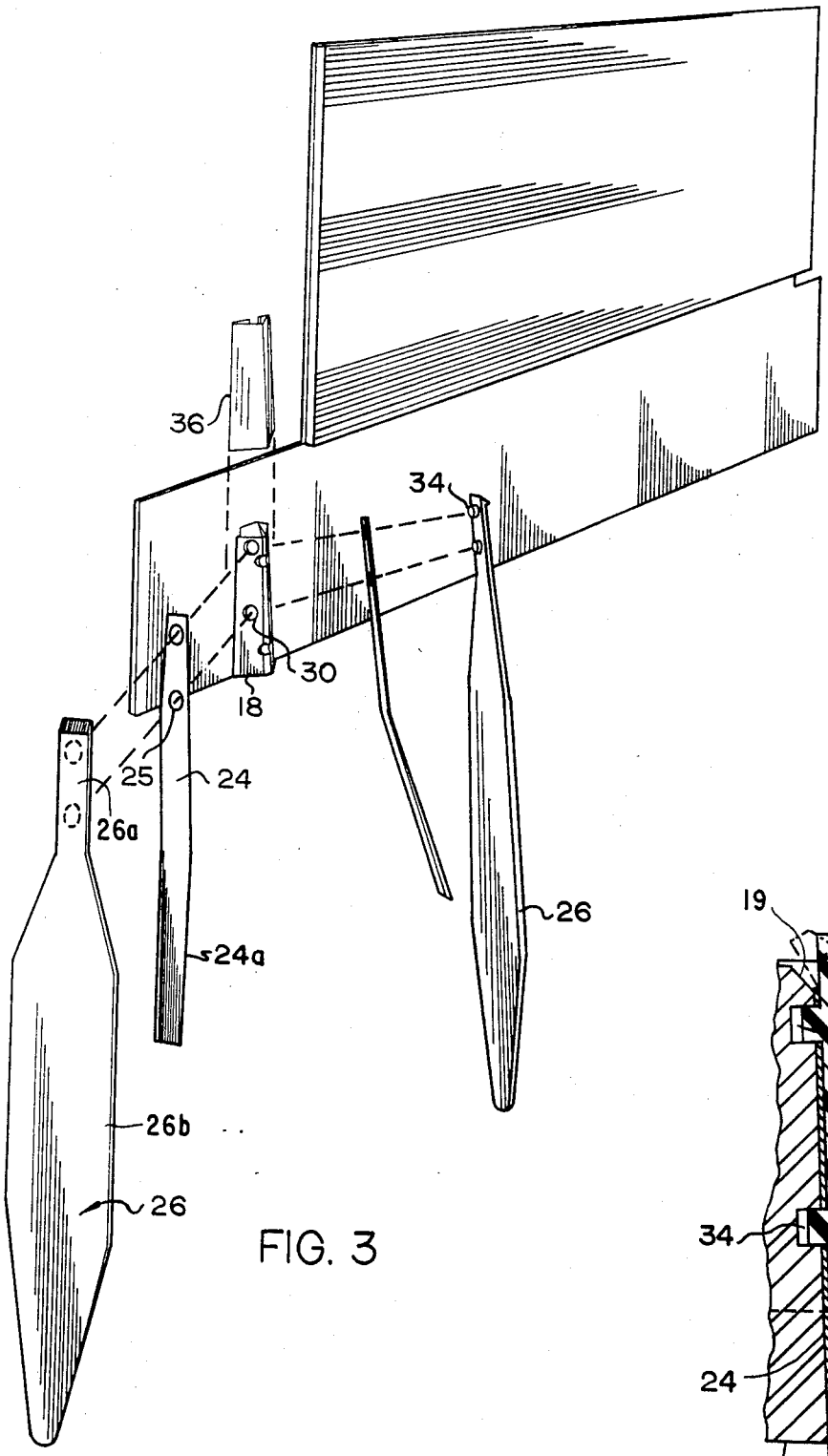
FIG. 3 is an exploded perspective view of spring finger means and the positioning member therefor as shown in FIG. 1.

FIG. 3 of the drawings shows that the spring finger means 16 comprise a metal leaf spring 24 and a plastic spring finger 26 with the metal leaf spring 24 having an end section 24*a* bent to engage a back portion of the plastic spring finger 26 and biases such plastic finger to extend away from the positioning membr 18. The metal leaf spring biases the lower ends of the plastic fingers into article engaging clusters. Usually the end section 24*a* engage the plastic fingers about midway between the upper and lower ends thereof. The components of the spring finger means 16 can be made of any suitable materials and the finger means can be a unitary member or can be made from two separate pieces as desired. In order to facilitate a positive engagement between the positioning member or block 18 and the spring finger means, preferably the positioning member 18 has a pair of spaced apertures or recesses 30, 30, or 32, 32 formed in each of such surfaces 20 and 22 respectively. Complementary interengaging means are formed on the spring finger means 16 and the support means therefore. These means comprise projections or little stubby cylinders 34, 34 formed integrally with the plastic leaf spring 26 and extending therefrom in properly positioned and sized relationship to be engaged with the holes formed in one of the surfaces 20 or 22 whereby accidental relative longitudinal movement of the spring finger means and the positioning member block is prevented. The stubby cylinders or pins 34 of the finger 26 also normally extend through holes 25 in the metal leaf springs 24 that are operatively biased into engagement with the back or undersurface of the plastic fingers 26. Or, short projections could be formed on the positioning block 18 to engage holes in the leaf spring 24 and the finger 26.

The plastic spring finger 26 has a reduced width neck portion 26*a* and a body portion 26*b* that depends from the neck portion when the spring finger 26 is operatively positioned. The neck portion 26*a* has inner and outer surfaces and the outer surface 27 is smooth and flat.

Final positive engagement between the spring finger means the positioning member or block 18 is obtained by means of a spring clip 26. This spring clip is elongate and is formed, in general complementary to the contour and length of the positioning member 18.

As previously stated, the surfaces 20 and 22 are substantially V-shape in contour in horizontal cross-section. Correspondingly, the clip 36 is of generally V-shape in cross-section and it does terminate in inwardly extending opposed flanges 38. These flanges 38 cooperate with the size and shape of the clip 36 and with the predetermined contour and size of the positioning member 18 so that the clip can be telescoped into engagement with the upper end of the positioning member and be slid down to engage therewith. The flanges 38 engage beneath base portions of the positioning member which member can be recessed if necessary at its edge portions to enable the flanges to be slid into engagment therewith. Normally, this positioning member 18 is of wedge or tapered shape in cross-section so that the clip 36 will positively engage therewith and can snuggly press or retain the spring finger means 16 in given positions on or forced against the surfaces 20 and 22. The clips 36 is, of course, sized so as to be slid into engagement with the positioning member 18 after the spring finger means 16 have been engaged therewith, and the clip is shorter than member 18.

Yet another feature of the present guide finger mounting apparatus is that the upper ends of the spring finger means and thus being the upper end of the plastic leaf spring 26 in the present embodiment of the invention has a an enlarged end, head or lip 40 formed thereon. Such lip extends away from the positioning member 18 and the spring finger means is of sufficient resilience that the clip 36 can be slid over the assembly of the spring fingers on the positioning member and ultimately have the upper end of the clip 36 snap over this lip 40. Then the resiliency of the spring finger means keeps the lip 40 engaged with the upper end of the clip or at least the spring finger member is so positioned that the spring finger means and especially the plastic leaf spring 26 cannot be pulled downwardly in relation to the clip at such time and relative movement in that direction between the positioning member and any component of the spring finger means is prevented.

Figure 4:
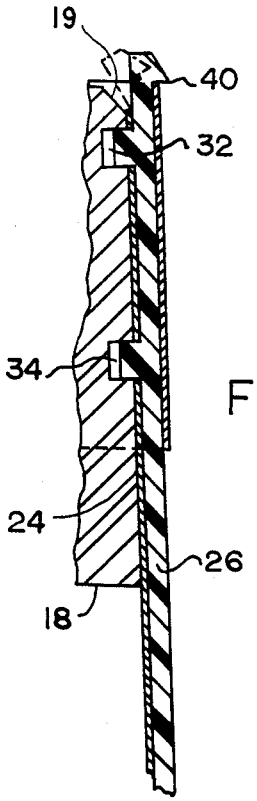
FIG. 4 is a fragmentary enlarged section taken on line 4—4 of FIG. 1.
Figure 9C:
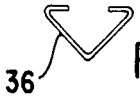
FIGS. 9*a*, 9*b*, 9*c* and 9*d* are front elevation, right side elevation, top plan and bottom plan, respectively, of the enclosure clip of FIG. 1.
Figure 8D:
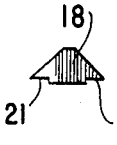
Figure 9D:
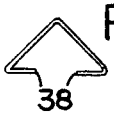
Figure 5:
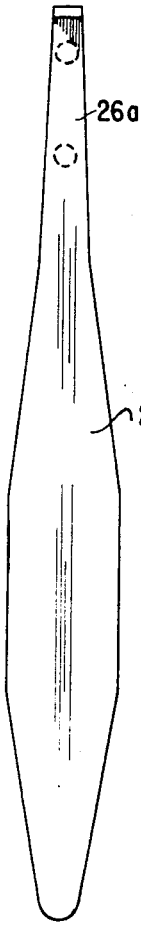
FIG. 5 is an elevation of a spring drop finger of FIG. 1.
Figure 6:
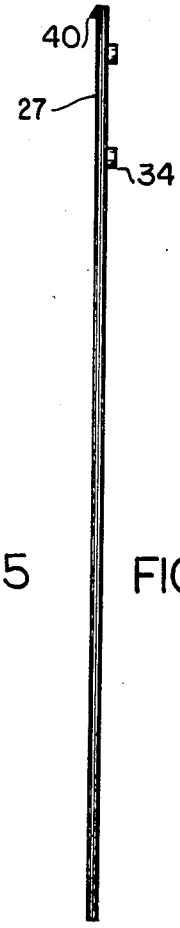
FIG. 6 is a side elevation of the drop finger of FIG. 5.
Figure 7:
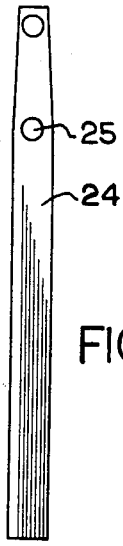
FIG. 7 is a plan of a spring back-up finger of FIG. 1 shown in elevation.
Figure 8:
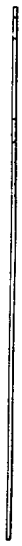
FIG. 8 is a side elevation of the spring fingers of FIG. 7.

Note that to remove the spring clip 36, the tab, or enlarged head 40 is merely pressed inwardly slightly as indicated in FIG. 4 to release the clip which can be manually slid upwardly for removal of the spring drop finger assembly. This action is made possible by providing a space behind the upper end of the finger 26 as by forming a beveled edge 17 on the positioning member 18. A beveled edge 17*a* also is provided on the positioning member 18. Such member 18 has undercuts 21 and 21*a*, FIG. 8*d*, formed on its longitudinally extending edges. Note that the body portion 26*b*, neck portion 26*a*, and head portion 40 are aligned longitudinally of the plastic spring finger 26.

FIG. 3 shows that the leaf springs 24 extend only about one half the length of the leaf springs 26 and that the leaf springs are only attached in position at their upper ends. The lower ends of such leaf springs can be sent to any desired shape or angle to aid in positioning the lower ends of the plastic springs.

In describing the present invention, the expression "spring finger means" is taken to mean any guide finger unit positioned in the case packer apparatus and wherein the guide finger mounting of the invention is used to position this unitary drop finger or drop finger made up from a plurality of separate parts, as desired, so that "spring finger means" is used to refer to any known type of guide finger used in case packer apparatus.

Figure 2:
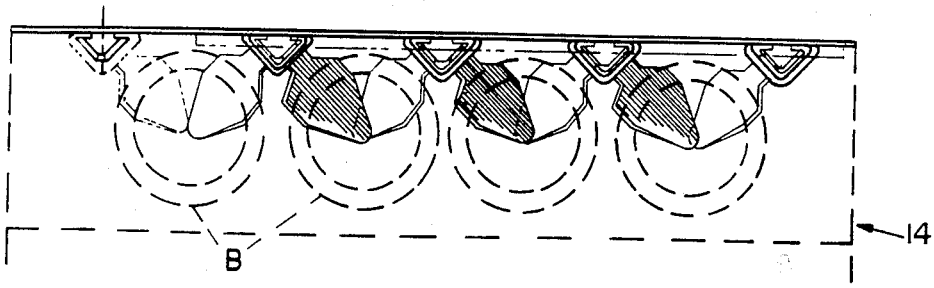
FIG. 2 is a plan view of the apparatus of FIG. 1.

In looking at prior U.S. Pat. No. 3,385,027, on a case packer head, it is seen that in some portions of the case packer head only one spring drop finger means need to be mounted on each one of the guide or positioning members 18. The positioning members and any spring drop finger means thereon can be mounted on the partition plates in any desired relationship. FIG. 2 shows a portion of a case packer head and only indicates guide finger mountings on one partition plate 12. In actual use, the article positioning or drop areas for articles collected into a group for case filling action are formed between a pair of adjacent partition plates. The spring finger means and positioning members used to define a drop area are thus mounted on the pairs of partition plates, normally, in the same manner as shown in U.S. Pat. No. 3,385,027.

The spring or guide finger mounting apparatus of the invention is easily or readily adapted to have the clip 36 be slid out of operative engagement with the positioning members 18 and any means thereon whereby the individual metal leaf springs or plastic leaf springs can be replaced or repaired as desired and a new one inserted into the assembly. All of such actions can normally be performed without the use of any external tools or guides and a rapid but positive repair of the guide finger mounting can be provided. Thus, the overall apparatus with which the grud assembly is used need not be out of service for any long length of time. Furthermore, it also is possible to have a plurality of these grid packer heads or assemblies around and use different packer heads with the apparatus at different times. Then repair of the drop fingers or portions of the packer assembly grid can be made at the workers convenience and no production time is lost.

It is believed that the objects of the invention have been obtained or achieved by the apparatus disclosed hereinabove.

While one complete embodiment of the invention has been disclosed herein, it will be appreciated that modification of this particular embodiment of the invention may be resorted to without departing from the scope of the invention.

What is claimed is:

1. A guide finger for use in an article drop assembly in case packers or the like including a positioner member having an anchoring means thereon and comprising an elongated, resilient plastic spring drop finger having a neck portion and a body portion, said neck position being narrow in relation to said body portion and being used for positioning the guide finger, said neck portion having inner and outer surfaces;

an anchoring means on said plastic spring drop finger neck portion inner surface complementary to the anchoring means on the positioner member to aid in operatively seating said plastic spring drop finger on said positioner member; and an enlarged head on said neck portion and protruding therefrom for engaging an end of a securing member when said drop finger is operatively positioned, such securing member being engagable with said positioner member to secured said guide finger thereto.

2. A guide finger as in claim 1 wherein said spring drop finger has a protruding cylindrical anchoring means thereon and said positioner member defines a hole that forms said anchoring means for said positioner member.

3. A guide finger for use in an article drop assembly in case packers, or the like, including a positioner member having a positioner surface with an anchoring recess thereon, and a retainer means for engaging said positioner member for securing the guide finger thereto, the guide finger comprising an elongated resilient plastic spring finger having neck, head and body portions, said neck portion being narrow in relation to said body portion and being used for positioning the guide finger on said positioner surface, said neck portion having inner and outer surfaces and a smooth outer surface;

a protruding anchoring means on said plastic spring drop finger neck portion inner surface complementary to the anchoring recess on the positioner member to aid in operatively seating said plastic spring drop finger on said positioner member; and said head portion protruding from said neck portion in at least one direction for engaging an end of the retainer means to aid in operatively positioning said drop finger.

* * * * *